United States Patent [19]

Hale

[11] Patent Number: 4,620,645

[45] Date of Patent: Nov. 4, 1986

[54] PORTABLE ASPHALT MELTING AND DISPENSING APPARATUS

[75] Inventor: Jordan C. Hale, NE. Albuquerque, N. Mex.

[73] Assignee: Aeroil Products Company, Inc., South Hackensack, N.J.

[21] Appl. No.: 593,618

[22] Filed: Mar. 26, 1984

[51] Int. Cl.[4] ..... B67D 5/62

[52] U.S. Cl. ..... 222/146.2; 222/152; 126/343.5 A

[58] Field of Search ..... 222/146.1, 146.2, 146.4, 222/146.5, 152, 53; 126/343.5 A, 343.5 R; 165/39, 104.31, 154, 155; 138/114, 137, 148

[56] References Cited

U.S. PATENT DOCUMENTS

| | | | |
|---|---|---|---|
| 1,292,365 | 1/1919 | Ostrander . | |
| 1,329,603 | 2/1920 | Hutchinson . | |
| 1,378,637 | 5/1921 | Wall . | |
| 1,924,636 | 8/1933 | Burket . | |
| 2,093,232 | 9/1937 | Coulter . | |
| 2,396,578 | 3/1946 | Kittel et al. . | |
| 2,645,524 | 7/1953 | Kelly | 222/148 X |
| 2,690,806 | 10/1954 | Britton et al. | 138/148 |
| 3,106,344 | 10/1963 | Baird, Jr. et al. | 222/146.2 |
| 3,299,417 | 1/1967 | Sibthorpe | 138/148 |
| 3,369,873 | 2/1968 | Ullrich et al. . | |
| 3,395,694 | 8/1968 | Ullman . | |
| 3,610,588 | 10/1971 | Diefenbach . | |
| 3,622,748 | 11/1971 | Sellers . | |
| 3,626,987 | 12/1971 | Bittner | 138/148 |
| 3,746,570 | 7/1973 | McIntosh | 222/152 X |
| 3,841,527 | 10/1974 | Von Roeschlaub | 222/146.2 |
| 3,880,228 | 4/1975 | Houk et al. | 165/104.31 |
| 3,946,722 | 3/1976 | Banahan . | |
| 3,995,616 | 12/1976 | Schrader . | |
| 4,159,877 | 7/1979 | Jacobson et al. . | |
| 4,442,954 | 4/1984 | Bergandy | 222/215 X |
| 4,474,311 | 10/1984 | Petrecca | 126/343.5 R |

*Primary Examiner*—Joseph J. Rolla
*Assistant Examiner*—Louise S. Heim
*Attorney, Agent, or Firm*—Lerner, David, Littenberg, Krumholz & Mentlik

[57] ABSTRACT

A portable self-contained asphalt melting and dispensing apparatus is disclosed. The apparatus is provided with a jacketed flexible hose having a controlled circulating system for circulating an oil heating medium, used for heating the asphalt in a kettle to also maintain the asphalt within the flexible hose in a fluid state during periods of non-use.

30 Claims, 2 Drawing Figures

PORTABLE ASPHALT MELTING AND DISPENSING APPARATUS

BACKGROUND OF THE INVENTION

The present invention relates in general to a melting and dispensing apparatus for solid materials such as tar, asphalt, and the like, and more particularly, to such an apparatus having a flexible discharge line adapted for dispensing, at various remote locations, such material being supplied from a source thereof in a heated, fluid condition, while maintaining the material in its fluid condition within the discharge line during periods of intermittent non-use of the apparatus.

In the resurfacing of roadways, it is required that cracks and joints in the surface of the roadway be filled prior to the resurfacing operation with tar or asphalt supplied to these voids in a heated, fluid condition. In order to economize the filling of these voids and to reduce the manual labor requirement, the prior art has recognized the desirability of providing a flexible discharge line, which can supply asphalt in a heated, fluid condition from an asphalt melting apparatus to various remote locations along the roadway. Commercial asphalt melting apparatus presently in use are constructed of a jacketed melting kettle using an oil heating medium within the kettle jacket to heat the solid asphalt to a fluid condition. The oil heating medium is directly heated within the jacket by an external fuel burner, typically using propane fuel. A flexible metal discharge hose is provided for dispensing the asphalt from the kettle in a fluid condition to the various remote locations by the manual manipulation of the discharge hose.

However, the conventional apparatus suffers from a number of notable disadvantages. For example, and most significantly, it is required that a continuous flow of asphalt in a heated fluid condition be supplied through the discharge hose to prevent its solidification therein. Thus, when an operator intermittently uses the apparatus, for example, when taking a break, during lunch, etc., the asphalt within the discharge hose often solidifies during this period, particularly in colder environments. In order to then use the apparatus for dispensing asphalt, the solidified asphalt within the discharge hose must be heated once again to a fluid condition, often by means of a blowtorch. In addition to this heating operation being time-consuming and labor intensive, the heat stress applied to the flexible metal discharge hose by a blowtorch seriously shortens its life span and/or causes the failure thereof, thereby necessitating its frequent replacement along with its associated economic loss and labor intensive requirement.

In U.S. Pat. No. 1,924,636, there is disclosed an asphalt melting apparatus adapted for use in filling cracks and joints in roadways with tar or tar compounds. The apparatus is constructed of a kettle directly heated by an underlying fuel burner, which are both rotationably mounted to a support structure. The asphalt, in a heated fluid condition, is discharged through a jacketed rigid conduit to the location of the joint or crack to be filled. A portion of the hot flue gases from the fuel burner are directed into the jacket surrounding the rigid conduit to prevent the solidification of the asphalt therein. During use, in order to manipulate the discharge end of the rigid conduit, it is required that the entire kettle and fuel burner be rotated about the underlying support structure. This manipulation requires the use of a complicated rotating assembly, which is not only expensive to manufacture, but which, due to the high temperature of its environment, is subject to a shortened life span. Further, the necessity of having to rotate the asphalt kettle and underlying fuel burner, as one can appreciate, is both dangerous to the operator and imposes severe limitations on the ability to position the discharge end of the rigid conduit at various remote locations. As the rigid conduit can only be rotated about the support structure, in order to position the discharge end at other than a circumferential position, it is required that the entire support structure, including asphalt kettle and fuel burner, be continuously moved in a random manner along the roadway. It can therefore be appreciated that this necessity of having to push the entire asphalt melting apparatus, as well as having to simultaneously rotate the asphalt kettle and fuel burner in order to dispense the asphalt at pre-selected locations, is both awkward, cumbersome, and highly undesirable.

Accordingly, it can be appreciated that there is an unsolved need for a portable, self-contained, asphalt melting and dispensing apparatus, which allows for the dispensing of asphalt in a heated fluid condition at remote locations independent of the location of the source of the asphalt, and which maintains the asphalt in a heated fluid condition within the discharge line during intermittant non-use of the apparatus.

SUMMARY OF THE INVENTION

It is broadly an object of the present invention to provide a melting and dispensing apparatus for solid materials, such as tar, asphalt, and the like, which overcomes or avoids one or more of the foregoing disadvantages resulting from the use of the abovementioned prior art asphalt melting apparatus, and which fulfills the specific requirements for such a melting and dispensing apparatus for use in filling cracks and joints with asphalt during the resurfacing of roadways or the like. Specifically, it is within the contemplation of one aspect of the present invention to provide a portable, self-contained asphalt melting and dispensing apparatus adapted for dispensing asphalt in a heated, fluid condition at various remote locations from a source thereof, while maintaining the asphalt in its heated, fluid condition during periods of intermittent non-use of the apparatus.

Another object of the present invention is to provide a portable, self-contained, asphalt melting and dispensing apparatus having means for dispensing asphalt in a heated, fluid condition at remote locations independent of the location of the source of the heated asphalt.

Another object of the present invention is to provide a portable, self-contained, asphalt melting and dispensing apparatus which is adapted to economize and minimize the manual labor requirements of filling joints and cracks in roadways to be resurfaced.

Another object of the present invention is to provide a portable, self-contained, asphalt melting and dispensing apparatus which maintains the asphalt in a discharge line in a heated, fluid condition at all times that the asphalt remains in the discharge line, including during non-use of the apparatus.

Another object of the present invention is to provide a portable, self-contained, asphalt melting and dispensing apparatus which utilizes the same oil heating medium used for melting the asphalt within a kettle and for maintaining the asphalt in a heated, fluid condition within a discharge line.

In accordance with one embodiment of the present invention, there is provided a portable asphalt melting and dispensing apparatus. The apparatus is constructed of storage means for storing asphalt in a heated, fluid condition, a rigid outer shell at least partially surrounding the storage means to provide a first heating region, a flexible hose of deformable material having an inlet arranged in fluid communication with the asphalt within the storage means and an outlet for controlling the discharge of the asphalt therefrom, a flexible outer shell surrounding the flexible hose substantially from the inlet to the outlet thereof to provide a second heating region, an oil heating medium provided within the first and second heating regions, circulating means for circulating the oil heating medium within the first and second heating regions, supplying means for supplying the asphalt in its heated, fluid condition from the storage means to the flexible hose for discharge through the outlet thereof, and control means for controlling the differential pressure between the oil heating medium within the second heating region and the asphalt within the flexbile hose, whereby the asphalt is maintained in its heated, fluid condition while it remains within the flexible hose, including during inoperation of the supplying means.

BRIEF DESCRIPTION OF THE DRAWINGS

The above description, as well as further objects, features and advantages of the present invention will be more fully understood by reference to the following detailed description of the presently preferred, but nonetheless illustrative, portable, self-contained asphalt melting and dispensing apparatus in accordance with the present invention, when taken in conjunction with the accompanying drawings, wherein.

DETAILED DESCRIPTION

Figure 1:
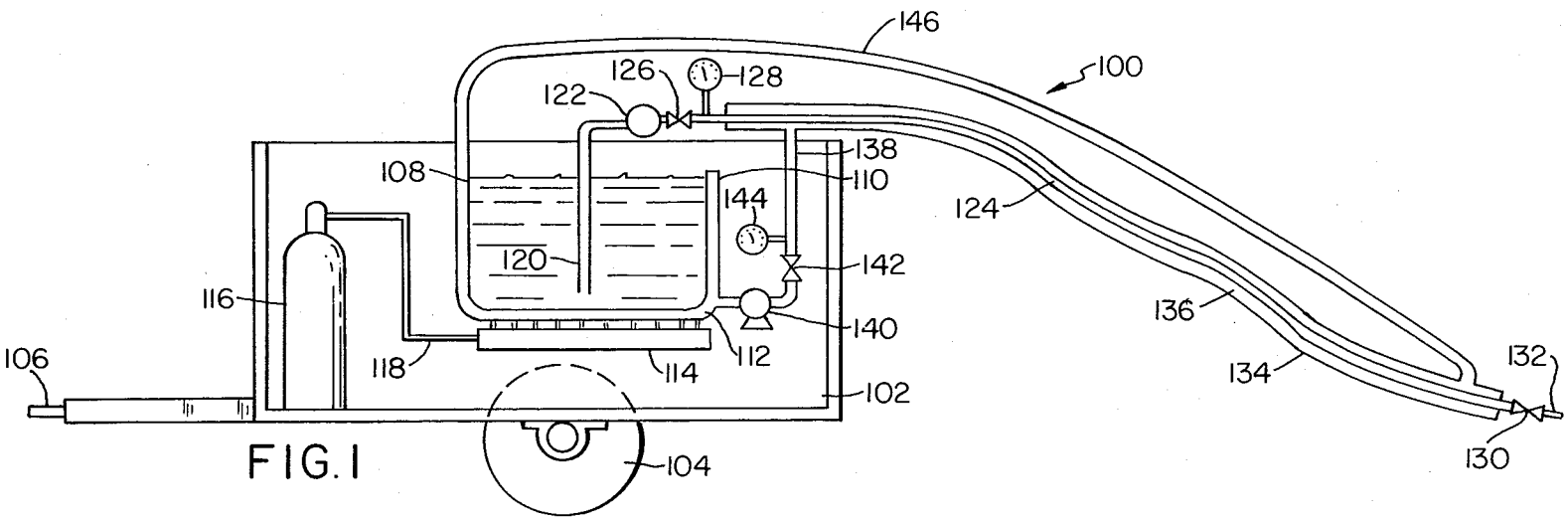
FIG. 1 is a diagrammatical view of a portable, self-contained, asphalt melting and dispensing apparatus having a flexible hose of deformable material and a flexible outer shell to provide a heating region for the circulation of an oil heating medium to maintain the asphalt in the hose in a fluid condition and showing one embodiment of control means for controlling the differential pressure between the oil heating medium and the asphalt therein.

Referring generally to the drawings wherein like reference numerals represent like elements, there is shown in FIG. 1 a diagrammatical view of a portable, self-contained, asphalt melting and apparatus generally designated by reference numeral 100. The dispensing apparatus 100 is also suitable for melting and dispensing other asphalt like materials, such as tar, tar compounds, rubberized asphalt, and the like, which materials are suitable for use in filling cracks and joints during the resurfacing operation of roadways. The apparatus 100 is constructed of a portable housing 102 movably supported on a roadway by means of a pair of wheels 104, only one of which is shown, and having an extending hitch 106 adapted for securing the apparatus to a moving vehicle for the transport of the apparatus to the resurfacing site. Contained within the housing 102 is a storage kettle 108 at least partially surrounded by a rigid outer shell 110 to provide a first heating region 112 therebetween. A fuel burner 114 is provided underlying the kettle 108 for heating an oil heating medium circulating within the first heating region 112. The fuel burner 114 may be constructed as a propane burner having a propane fuel source 116 communicating therewith by means of supply line 118. A dip tube 120 is arranged extending within the kettle 108, and has an outlet connected to the inlet of a supply pump 122. The outlet of the supply pump 122 is, in turn, connected to the inlet of a flexible hose 124 constructed of deformable material. A throttle valve 126 and pressure gauge 128 are arranged between the outlet of the supply pump 122 and inlet of the flexible hose 124. The outlet of the flexible hose 124 is provided with a control valve 130 and a nozzle 132.

A flexible outer shell 134 is arranged surrounding the flexible hose 124 substantially from its inlet to its outlet to provide a second heating region 136 therebetween. The second heating region 136 is arranged in fluid communication with the first heating region 112 by means of a fluid pipe 138. The oil heating medium within the first heating region 112 is circulated within the second heating region 136 by means of a circulating pump 140 arranged within the fluid pipe 138. A throttle valve 142 and pressure gauge 144 are arranged within the fluid pipe 138 adjacent the outlet of the circulating pump 140. A recirculating line 146 is arranged to provide fluid communication between the second heating region 136 at a location adjacent the control valve 130 at the discharge end of the flexible hose 124 and the first heating region 112 at a preselected portion about the kettle 108.

Flexible hose 124 may be of any convenient length desired, so as to provide a sufficient degree of freedom of mobility of the nozzle 132 about the area of the roadway having cracks and joints to be sealed. The flexible hose 124, flexible outer shell 134 and recirculating line 146 are constructed of a flexible metal woven outer shell having a Teflon liner. The Teflon liner, being heat resistant, contains the heated asphalt and oil heating medium, while the metal woven outer shell prevents rupture of the Teflon liner when under interval pressure and providing mechanical strength and durability to the flexible hose 124, flexible outer shell 134 and recirculating line 146. One source of supply for the flexible hose 124, flexible outer shell 134, and recirculating line 146 is Aeroquip Corporation, which provides these components in various diameters having an operating temperature range of about 550°-600° F. at a pressure rating of up to 1200 psi.

In operation of the apparatus 100, the portable housing 102 is attached to a vehicle (not shown) by means of the hitch 106 and transported to the site of road repair. The kettle 108 is filled with asphalt in a solid form and the fuel burner 114 is ignited. The fuel burner 114, by heating the oil heating medium within the first heating region 112, causes the asphalt within the kettle 108 to melt into a heated, fluid condition. The heated asphalt from the kettle 108 is withdrawn through the dip tube 120 by means of the supply pump 122 and fed through the flexible hose 124 for discharge through the nozzle 132. The discharge of the asphalt through the nozzle 132 is controlled by the operator using the control valve 130. To maintain the asphalt within the flexible hose 124 in a heated fluid condition, the oil heating medium within the first heating region 112 is circulated through the second heating region 136 by means of the circulating pump 140. The oil heating medium as heated by the fuel burner 114 is circulated through the fluid pipe 138, through the second heating region 136 along the entire length of the flexible hose 124, and then recirculated back to the first heating region 112 by means of the recirculating line 146.

As a result of constructing the flexible hose 124 from a metal woven outer shell having a Teflon liner, the flexible hose is both capable of withstanding internal pressures of up to 1200 psi, while at the same time being of a deformable nature, as well as this also being subject to collapse upon the application of a sufficient external pressure. To prevent the collapse of the flexible hose 124 during use of the apparatus 100, it is desirable to control the differential pressure between the oil heating medium within the second heating region 136 and the pressure of the heated asphalt within the flexible hose 124. To this end, the throttle valves 126, 142 have been provided at the outlets to their respective pumps 122, 140. By throttling the throttle valve 142, the pressure of the oil heating medium, within the second heating region 136, as indicated by the pressure gauge 144, can be controlled. Likewise, by throttling the throttle valve 126, the pressure of the heated asphalt within the flexible hose 124, as indicated by the pressure gauge 128, can be controlled. Although it is considered desirable to only maintain the pressure of the asphalt within the flexible hose 124 at least equal to the pressure of the oil heating medium within the second heating region 136, it is preferred that the differential pressure be in a range of about 15 to 20 psi. However, a differential pressure as low as about 1 psi has been found satisfactory to prevent collapse of the flexible hose.

Figure 2:
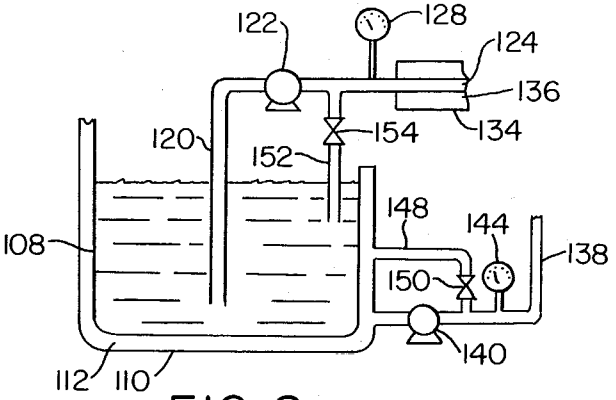
FIG. 2 is a diagrammatical view of another embodiment of the control means comprising a pair of by-pass pipes adapted for recirculating a portion of the flow of the oil heating medium and asphalt.

Referring now to FIG. 2, there is shown a second embodiment in accordance with the present invention for controlling the differential pressure between the oil heating medium within the second heating region 136 and the asphalt within the flexible hose 124. The fluid pipe 138 is provided with a by-pass pipe 148 arranged at the outlet of the circulating pump 140 for by-passing a portion of the oil heating medium back to the first heating region 112. A throttle valve 150 is provided within the by-pass pipe 148 for controlling the amount of oil heating medium being by-passed to the first heating region 112. In this manner, the throttle valve 150 controls the pressure of the oil heating medium within the second heating region 136. Similarly, a by-pass pipe 152 is arranged at the output of the supply pump 122 for recirculating a portion of the heated asphalt back to the kettle 108. A throttle value 154 is arranged within the by-pass pipe 152 for controlling the amount of the asphalt being recirculated back the kettle 108. In this manner, the pressure of the asphalt within the flexible hose 124 can be controlled. It should be understood that various other arrangements for controlling the differential pressure of the asphalt within the flexible hose 124 and the oil heating medium within the second heating region 136 may be employed within the apparatus 100 of the present invention.

From the foregoing description of the apparatus 100 in accordance with the present invention, the operator of the apparatus 100 can manipulate the nozzle 132 at the discharge end of the flexible hose 124 to a variety of locations for filling cracks and joints with heated asphalt without the necessity of having to move the portable housing 102. This mobility and freedom of use of the apparatus 100 results from the flexible nature of the flexible hose 124 and the flexible outer shell 134. By incorporating a flexible hose 124 of suitable length, it can readily be appreciated that a rather large area of roadway may be repaired without the necessity of having to move the portable housing 102. When the operator desires to take a break, such as during lunch, it is merely required that the control valve 130 be closed. In this regard, the oil heating medium circulating within the second heating region 136 by means of the circulating pump 140 maintains the asphalt within the flexible hose 124 in a fluid condition. Upon return of the operator, the apparatus 100 is immediately available for use, thereby avoiding the necessity of having to reheat the asphalt within the flexible hose 124. The foregoing construction of the apparatus 100 has resulted in substantial savings of time and labor by allowing for the immediate use of the apparatus 100, even after intermittent periods of non-use.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of this invention as defined by the appended claims.

What is claimed is:

1. A portable asphalt melting and dispensing apparatus, said apparatus comprising storage means for storing asphalt in a heated, fluid condition, a rigid outer shell at least partially surrounding said storage means to provide a first heating region, a flexible hose of deformable material having an inlet arranged in fluid communication with said asphalt within said storage means and an outlet for controlling the discharge of said asphalt therefrom, a flexible outer shell concentrically surrounding said flexible hose to provide a second heating region having an annular shaped cross-section extending between said inlet and said outlet thereof, an oil heating medium provided within said first and second heating regions, said oil heating medium in contact with an outer surface of said flexible hose within said second heating region, circulating means for circulating said oil heating medium within said first and second heating regions, supplying means for supplying said asphalt in said heated fluid condition from said storage means to said flexible hose for discharge through said outlet thereof, and control means for controlling the differential pressure between said oil heating medium within said second region and said asphalt within said flexible hose, whereby said asphalt may be maintained in said heated fluid condition while it is within said flexible hose.

2. The apparatus of claim 1, wherein said flexible hose comprises a Teflon liner.

3. The apparatus of claim 1, wherein said control means includes means for maintaining the pressure of said asphalt within said flexible hose at least equal to the pressure of said oil heating medium within said second heating region, so as to prevent the deformation of said flexible hose.

4. The apparatus of claim 1, further including heating means for heating said oil heating medium within said first heating region.

5. The apparatus of claim 1, wherein said flexible outer shell is constructed of a metal woven outer shell having a Teflon liner.

6. The apparatus of claim 1, wherein said circulating means comprises a pump.

7. The apparatus of claim 1, wherein said supplying means comprises a pump.

8. The apparatus of claim 1, wherein said circulating means is arranged between said first and second heating regions.

9. The apparatus of claim 1, wherein said supplying means is arranged between said storage means and said inlet of said flexible hose.

10. The apparatus of claim 1, wherein said control means comprise a first throttle valve arranged between said second heating region and said circulating means.

11. The apparatus of claim 10, wherein said control means further includes a second throttle valve arranged between said supplying means and said inlet of said flexible hose.

12. The apparatus of claim 1, wherein said control means includes a first by-pass conduit arranged between said second heating region and said circulating means for limiting the pressure of said oil heating medium within said second heating region by returning a quantity of said oil heating medium, being circulated by said circulating means, to said first heating region.

13. The apparatus of claim 12, wherein said control means further includes a second by-pass conduit arranged between said supplying means and said inlet of said flexible hose for limiting the pressure of said asphalt within said flexible hose by returning a quantity of said asphalt being supplied by said supplying means, to said storage means.

14. The apparatus of claim 1, wherein said flexible hose and said second heating region are coextensive.

15. The apparatus of claim 1, wherein said outlet of said flexible hose can be positioned at remote locations independent of the movement of said storage means.

16. The apparatus of claim 1, wherein said control means control the pressure of said oil heating medium within said second heating region and the pressure of said asphalt within said flexible hose.

17. The apparatus of claim 1, wherein said differential pressure is in the range of about 15 to 20 psi.

18. The apparatus of claim 1, wherein the pressure of said asphalt is greater than the pressure of said oil heating medium.

19. The apparatus of claim 1, further including a return line connected between said flexible outer shell and said first heating region for returning said oil heating medium from said second heating region to said first heating region.

20. A portable asphalt melting and dispensing apparatus, said apparatus comprising storage means for storing asphalt in a heated, fluid condition, an outer shell at least partially surrounding said storage means to provide a first heating region, a flexible hose of deformable material having an inlet arranged in fluid communication with said asphalt within said storage means and an outlet for controlling the discharge of said asphalt therefrom, a flexible outer shell concentrically surrounding said flexible hose to provide an annular heating chamber extending between said inlet and said outlet thereof, a heating medium provided within said first heating region and said annular heating chamber, said heating medium in contact with the outer surface of said flexible hose within said annular heating chamber, circulating means for circulating said heating medium within said first heating region and said annular heating chamber whereby said asphalt is maintained in said heated fluid condition while within said flexible hose, supplying means for supplying said asphalt in said heated fluid condition from said storage means to said flexible hose for discharge through said outlet thereof.

21. The apparatus of claim 20, wherein said flexible hose comprises a Teflon liner.

22. The apparatus of claim 20, wherein said control means includes means for maintaining the pressure of said asphalt within said flexible hose at least equal to the pressure of said heating medium within said annular heating chambers, so as to prevent the deformation of said flexible hose.

23. The apparatus of claim 20, wherein said flexible outer shell is constructed of a metal woven outer shell having a Teflon liner.

24. The apparatus of claim 20, wherein said control means comprises a first throttle valve arranged between said annular heating chamber and said circulating means and a second throttle valve arranged between said supplying means and said inlet of said flexible hose.

25. The apparatus of claim 20, wherein said control means includes a first by-pass conduit arranged between said annular heating chamber and said circulating means for limiting the pressure of said heating medium within said annular heating chamber by returning a quantity of said heating medium, being circulated by said circulating means, to said first heating region.

26. The apparatus of claim 25, wherein said control means further includes a second by-pass conduit arranged between said supplying means and said inlet of said flexible hose for limiting the pressure of said asphalt within said flexible hose by returning a quantity of said asphalt being supplied by said supplying means to said storage means.

27. The apparatus of claim 20, wherein said heating medium flows within said annular heating chamber concurrently with the flow of said asphalt within said flexible hose.

28. The apparatus of claim 20, wherein said annular heating chamber is substantially co-extensive with said flexible hose between said inlet and said outlet thereof.

29. The apparatus of claim 20, wherein said heating medium is in further contact with the inner surface of said flexible outer shell.

30. A portable asphalt melting and dispensing apparatus, said apparatus comprising storage means for storing asphalt in a heated, fluid condition, a rigid outer shell at least partially surrounding said storage means to prvoide a first heating region, a circular flexible hose of deformable material having an inlet arranged in fluid communication with said asphalt within said storage means and an outlet for controlling the discharge of said asphalt therefrom, said outlet of said flexible hose positionable at remote locations independent of the movement of said storage means, an annular heating chamber provided by a circular flexible outer shell concentrically surrounding said flexible hose to provide a second heating region having a uniform annular shaped cross-section extending around said flexible hose and between said inlet and said outlet thereof, an oil heating medium provided within said first and second heating regions, said oil heating medium in direct contact with the entire outer surface of said flexible hose within said second heating region, circulating means comprising a pump for circulating said oil heatingmedium within said first and second heating regions, supplying means comprising a pump for supplying said asphalt in said heated fluid condition from said storage means to said flexible hose for discharge through said outlet thereof, and control means for controlling the differential pressure between said oil heating medium within said second heating region and said asphalt within said flexible hose, said control means including means for maintaining the pressure of said asphalt within said flexible hose at least equal to the pressure of said heating medium within said annular heating chamber so as to prevent the deformation of said flexible hose, said control means including a first by-pass conduit arranged between said annular heating chamber and said circulating means for limiting the pressure of said heating medium within said annular heating chamber by returning a quantity of said heating medium being circulated by said circulating means to said first heating region and a second by-pass conduit arranged between said supplying means and said inlet of said flexible hose for limiting the pressure of said asphalt within said flexible hose by returning a quantity of said asphalt being supplied by said supplying means to said storage means, said heating medium flowing within said annular heating chamber concurrently with the flow of said asphalt within said flexible hose, whereby said asphalt may be maintained in said heated fluid condition while it is within said flexible hose.

* * * * *

UNITED STATES PATENT AND TRADEMARK OFFICE

CERTIFICATE OF CORRECTION

PATENT NO. : 4,620,645

DATED : November 4, 1986

INVENTOR(S) : Jordan C. Hale

It is certified that error appears in the above-identified patent and that said Letters Patent is hereby corrected as shown below:

Column 8:

line 2, after "thereof" insert --and control means for controlling the differential pressure between said heating medium within said annular heating chamber and said asphalt within said flexible hose--;

line 47, delete "prvoide" and insert --provide--;

line 63, delete "heatingmedium" and insert --heating medium--.

Signed and Sealed this

Twenty-eighth Day of April, 1987

*Attest:*

*Attesting Officer*

DONALD J. QUIGG

*Commissioner of Patents and Trademarks*